US005351681A

United States Patent [19]

Hudson

[11] Patent Number: 5,351,681

[45] Date of Patent: Oct. 4, 1994

[54] UNDERWATER BREATHING APPARATUS FOR A SWIMMER

[76] Inventor: William C. Hudson, 5609 St. Charles Dr., Woodbridge, Va. 22193

[21] Appl. No.: 60,527

[22] Filed: May 13, 1993

[51] Int. Cl.[5] ..... B63C 11/16; B63C 11/02

[52] U.S. Cl. ..... 128/201.11; 128/201.27

[58] Field of Search ..... 128/201.11, 201.27, 128/201.28, 202.14, 200.24, 205.22, 912, 207.14, 207.17, 911; 441/6, 27; 114/315; 482/13

[56] References Cited

U.S. PATENT DOCUMENTS

| | | | |
|---|---|---|---|
| 3,064,646 | 11/1962 | Miller | 128/201.11 |
| 3,139,087 | 6/1964 | Liberatore | 128/201.11 |
| 3,140,551 | 7/1964 | Wayfield | 128/201.11 |
| 3,827,093 | 8/1974 | Davis . | |
| 3,860,042 | 1/1975 | Green | 128/201.11 |
| 4,269,182 | 5/1982 | Le | 128/201.11 |
| 4,583,536 | 4/1986 | Jan | 128/201.11 |
| 4,610,246 | 9/1986 | Delphia | 128/201.11 |
| 4,655,212 | 4/1987 | Delphia | 128/201.11 |
| 4,872,453 | 10/1989 | Christianson | 128/201.11 |
| 4,928,687 | 5/1990 | Lampotang et al. | 128/200.26 |
| 4,986,267 | 1/1991 | Doss | 128/201.27 |
| 5,027,805 | 7/1991 | Kung | 128/201.11 |
| 5,176,169 | 1/1993 | Ferguson | 137/454.5 |
| 5,193,530 | 3/1993 | Gamow et al. | 128/201.27 |
| 5,199,422 | 4/1993 | Rasocha | 128/201.11 |

FOREIGN PATENT DOCUMENTS

| | | | |
|---|---|---|---|
| 0169393 | 6/1990 | Japan | 128/201.11 |

*Primary Examiner*—Kimberly L. Asher
*Attorney, Agent, or Firm*—Richard C. Litman

[57] ABSTRACT

An underwater breathing apparatus well suited for beginning snorkelers, having a mouthpiece, a floating air pickup, and a flexible breathing tube connecting the two. The mouthpiece has a one-way inlet valve and a one-way outlet valve. Air flow is thus rendered unidirectional. Air flows in from the pickup, through the breathing tube, and then to the mouthpiece. The inlet valve prevents the breathing tube from collecting water. The outlet valve discharges spent air and collected water to the exterior. Air thus expelled simulates scuba breathing. The flexible breathing tube enables a novice to enjoy snorkeling without being obliged to hold a rigid breathing tube upright. The floating air pickup has angled, swiveling connection to the breathing tube, thus rendering the float more stable. In alternative embodiments, the breathing supply is manifolded to supply more than one user. In further alternative embodiments, the apparatus includes a hook or eyelet for retaining small personal articles on the float, and includes indicators for observers above the water level to monitor correct breathing procedure. The float is brightly colored to enable an observer to locate the apparatus at a distance.

9 Claims, 4 Drawing Sheets

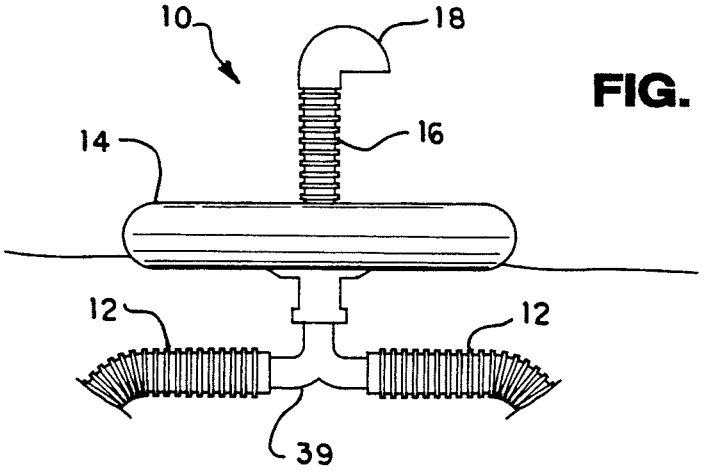
FIG. 3
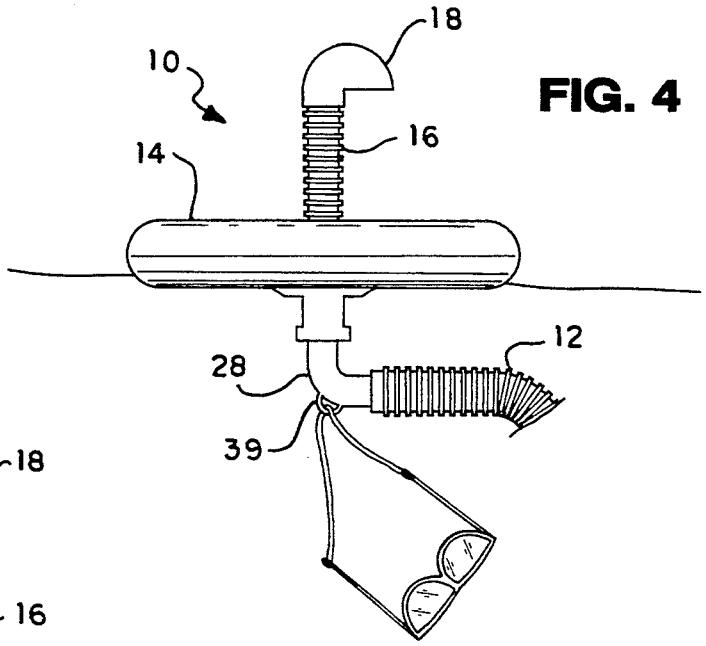
FIG. 4
FIG. 5
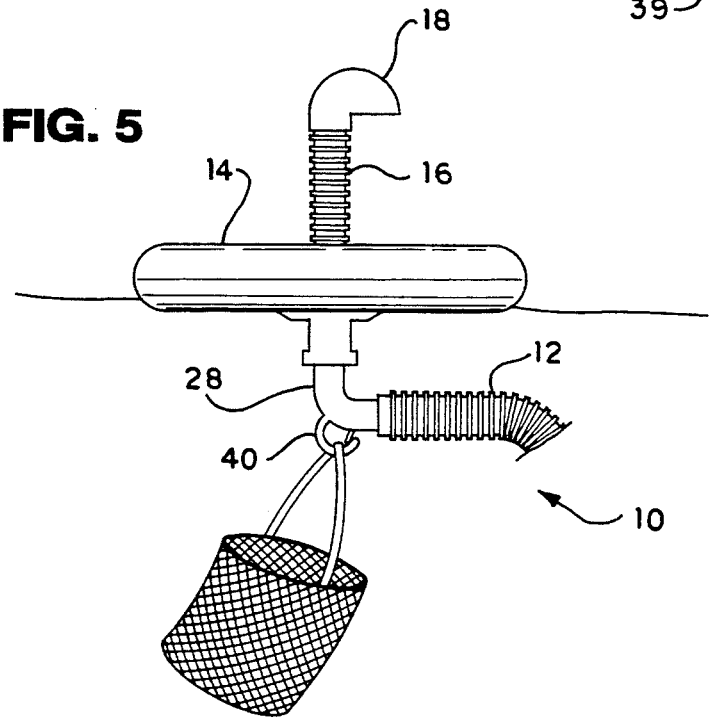

UNDERWATER BREATHING APPARATUS FOR A SWIMMER

BACKGROUND OF THE INVENTION

1. FIELD OF THE INVENTION

The present invention relates to an underwater breathing apparatus adapted for use by a swimmer to facilitate remaining submerged for extended periods of time without the use of compressed air tanks or regulators.

2. DESCRIPTION OF THE PRIOR ART

A diving snorkel assembly comprising a snorkel tube having an inhalation check valve at the upper end of tube, and a mouthpiece at its lower end is seen in U.S. Pat. Nos. 3,860,042, issued to Thomas A. Green on Jan. 14,1975, 4,610,246, issued to John B. Delphia on Sep. 9, 1986, and 4,655,212, issued to John B. Delphia on Apr. 7, 1987. An exhaust valve disposed adjacent to the mouthpiece enables one-way flow, with air entering through an intake and discharging through the exhaust valve into the water.

U.S. Pat. Nos. 3,064,646, issued to G. L. Miller on Nov. 20, 1962 and 5,027,805, issued to Kuo-Lang Kung on Jul. 2, 1991 disclose an underwater breathing apparatus including a face mask and an elongated flexible air pipe having one end attached to the mask. A float is connected to the other end of the air pipe, so the intake end of the air pipe sits above water level. In addition, U.S. Pat. No. 4,583,536, issued to Rong J. Jan, comprises a mouthpiece and an elongated flexible air pipe having one end attached to the mouthpiece. An inflatable floating body engages the other end of the air pipe exposing the end to the atmosphere.

U.S. Pat. No. 4,872,453, issued to Tony Christianson on Oct. 10, 1989 relates to an underwater breathing apparatus for purging water from a flooded snorkel. Christianson discusses a snorkel having a conduit with an unobstructed, open end above water and an underwater end with an attached mouthpiece. A chamber intersecting the conduit houses a float member which is buoyed into the conduit and blocks the upward air flow therein. A purge valve located adjacent and below the mouthpiece displaces water in the conduit by exhaling into the mouthpiece, forcing the trapped water down and out the valve.

None of the above inventions and patents, taken either singly or in combination, is seen to describe the instant invention as claimed.

SUMMARY OF THE INVENTION

The main object of this invention is to provide an improved underwater breathing assembly which eliminates the need to use compressed air tanks and air regulators. The underwater breathing assembly enables a swimmer to remain underwater and continue breathing without bringing one's head out of the water.

In conventional devices of this type, where inhalation and exhalation take place through the same tube, a portion of the carbon dioxide laden air is rebreathed or re-inhaled. Further, a trap bend is typically located in conventional air breathing conduits, to hold water which might enter the extending end of the tube from reaching the mouthpiece. After a period of use, by exhaling sharply into the mouthpiece, water is purged upwardly into the main breathing conduit, and out therefrom. However, the path traveled by the expelled water is the length of the breathing conduit. Therefore, purging must be performed in open air, or else enormous effort is required.

The structure of the present invention obviates these difficulties by providing a float which supports an air intake above the water level.

An intake tube extends upwardly through the float, and is protected by a weather hood. The air intake tube extends below the float, attaching to a swiveling angled connector. The connector attaches to a flexible breathing tube, which brings air to a conventional mouthpiece. An important function provided by the angled connector is that when the swimmer exerts a pull on the breathing tube, the float is pulled laterally, rather than downwardly. The float thus remains stable on the water surface, rather than possibly being upset. If the float were upset, the breathing tube could unexpectedly conduct water to the user.

Another less dramatic, but nonetheless hazardous result is a sudden jerking motion due to buoyant reaction to a downward tug. If such jerking motions were present, they would tend to pull at the user's mouthpiece, thus increasing the danger of removing the apparatus from the user's mouth. Again, the angle of the connector helps to prevent such an occurrence.

The float is preferably toroidal, and has a web which extends across and seals the float. A tray is thus formed which enables a swimmer to carry and collect items while continuing to swim.

Air flows into the underwater breathing assembly through the weather hood's then through the intake tube, continuing down into the swiveling, angled connector through the breathing tube, then into the mouthpiece.

The mouthpiece includes an inhalation check valve which constrains air to flow unidirectionally into the mouthpiece. The inhalation check valve prevents carbon dioxide laden air from returning into the air conduit and being rebreathed by the user. An exhalation check valve disposed between the mouthpiece and the remote end of the snorkel assembly allows a one-way exhaust of water and air from the air conduit tube. A high performance air flow is thereby maintained which expels dead air and trapped water from the passageway.

The exhalation of the carbon dioxide and water is simulative to the air release action of a scuba diver's breathing technique in the water. The apparatus thus teaches the beginning steps of underwater breathing skills and diving techniques to young or old potential scuba enthusiasts.

In alternative embodiments, the float includes attachment members, in the form of hooks and eyelets, which enable small items to be attached to the float to suspend therefrom.

In still further embodiments, the underwater breathing assembly includes audible and visible indicators, so that an observer may monitor the proper breathing by the person using the novel apparatus. This is a useful feature, since the present invention provides an intriguing and practical way to introduce newcomers to swimming underwater. Since newcomers may well include children, adult supervisors can remain confident that novice users are breathing effectively. A brightly colored float surface provides further assistance in locating and monitoring the novice user.

Accordingly, it is an important object of the invention to provide an underwater breathing assembly having a flexible breathing tube which is attached at a right angle to the air intake, and parallel to the surface of the water.

Another object of the invention is to provide an underwater breathing assembly simulating the air release action of a scuba diver's breathing technique, without bringing one's face out of the water.

It is another object of the invention to provide a swiveling connection to a breathing tube, thus redirecting the conduit with respect to the relatively immobile, floating air pickup, thus reducing the chance of entanglement of the float and sudden removal of the mouthpiece from the user.

It is a further object of the invention to provide an air pickup connecting to plural inhalation tubes, whereby more than one swimmer may be engaged to a single floating air pickup unit.

Still another object of the invention is to provide a float having a tray for carrying small items.

A further object is to provide indication so that an observer above water can determine whether breathing through the underwater breathing device is being performed properly.

A still further object is to provide a highly conspicuous float so that an observer above water can readily locate the underwater breathing device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a side elevational view of the novel snorkeling apparatus showing an embodiment wherein more than one user can attach thereto.

FIGS. 4 and 5 are side elevational views of the novel underwater breathing apparatus, showing alternative embodiments including attachment apparatus.

DETAILED DESCRIPTION OF THE PREFERRED EMBODIMENTS

Figure 1:
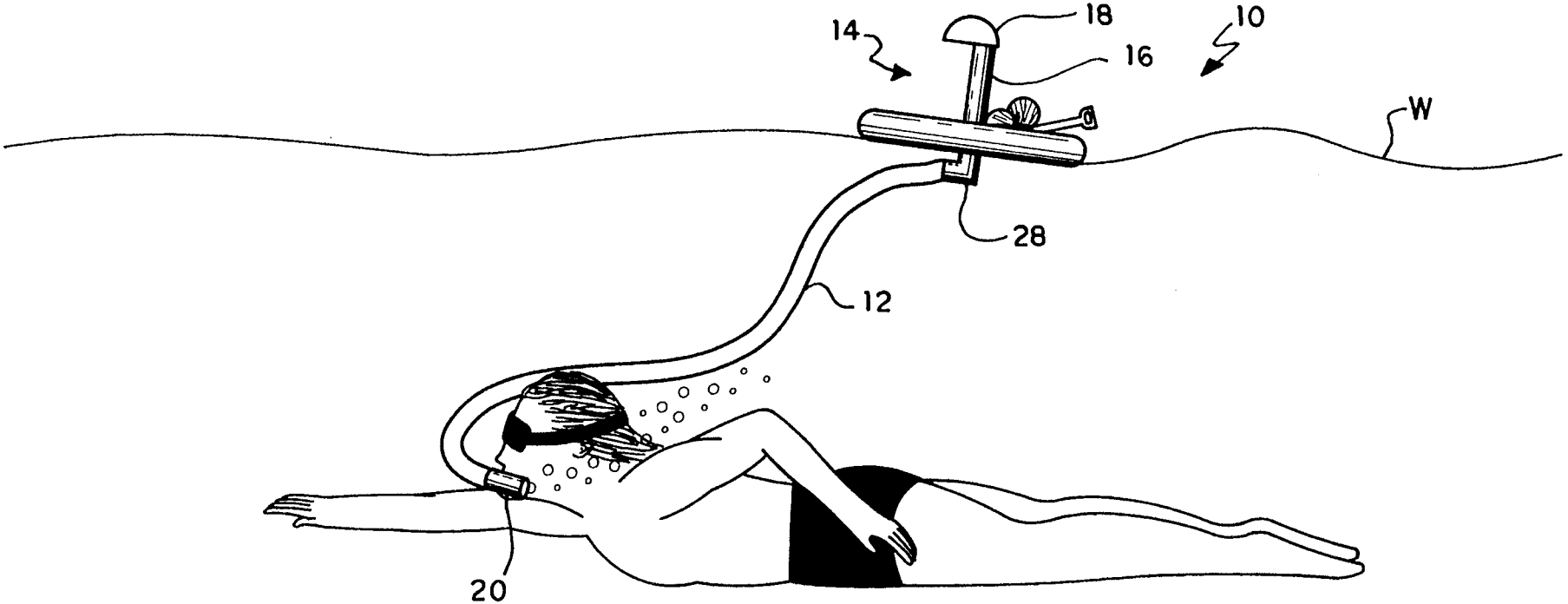
FIG. 1 is an environmental perspective view of the invention.

The present invention, seen in FIG. 1, provides an underwater breathing apparatus 10 which features a flexible breathing tube 12. A float 14 holds a proximal end of breathing tube 12 in communication with an air intake tube 16. Intake tube 16 is held above the level of water W, a weather hood 18 preventing direct entry of water thereinto. A distal end of breathing tube 12 communicates with a conventional mouthpiece 20.

Figure 2:
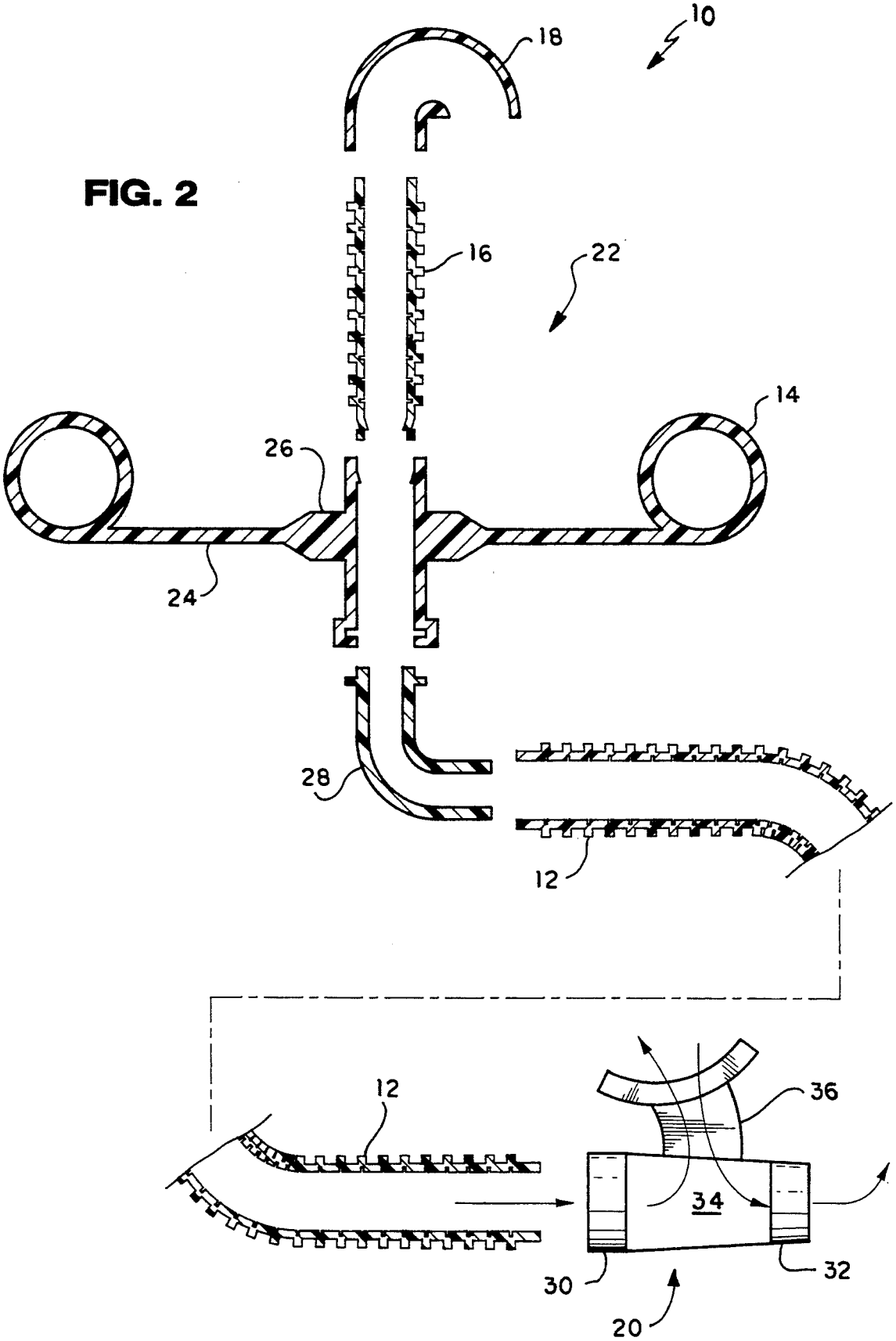
FIG. 2 is a cross-sectional, exploded view of the invention.

The underwater breathing apparatus 10 is seen in greater detail in FIG. 2. Float 14 preferably is configured toroidally, defining a central opening 22. A web 24 extends across and seals central opening 22, and forms a tray 23 which enables a swimmer shown in FIG. 1 to carry and collect items while continuing to swimmer. Web 24 includes a reinforced portion 26 which supports intake tube 16 such that it extends upwardly above water level W. Weather hood 18 attaches to intake tube 16, and includes an orifice which opens downwardly.

Rotatably anchored to reinforced portion 26 is a swiveling right-angled connector 28. Breathing tube 12, which is flexible due to bellows construction, communicates between intake tube 16 and mouthpiece 20. Mouthpiece 20 has an inlet check valve 30 and an outlet check valve 32, which are arranged as follows to ensure unidirectional air flow. Inlet check valve 30 is disposed between the distal end of breathing tube 12, and mouthpiece 20. Outlet check valve 32 forms a discharge port releasing air, and water, if any has collected in mouthpiece 20, to the surrounding water. A chamber 34 is defined in mouthpiece 20 between inlet check valve 30 and outlet check valve 32. Chamber 34 also communicates with a conduit 36 leading to the swimmer's mouth (not shown).

Air flow is thus constrained only to enter chamber 34 by check valve 30 and only to exit chamber 34 by check valve 32. Air flows alternately in and out through conduit 36 while breathing. Arrows indicate this air flow arrangement.

It is advantageous to minimize volume of chamber 34. Minimal volume enables a user to purge chamber 34 of water which may have entered thereinto, as by unintended slippage past the user's lips. The advantage lies in that effort required to force water and air out from chamber 34 is minimized, and may be performed during routine breathing. Most prior art devices require the user to come to the surface to purge water.

A second embodiment, shown in FIG. 3, provides a "T" shaped connector 38 for two swimmers to be attached to the underwater breathing apparatus 10. Of course, connector 38 could be designed to accommodate any desired number of users.

In further alternative embodiments, attachment accessories enabling attachment of personal items to float 14 are formed on connector 28. An eyelet 39 is illustrated in FIG. 4. A further alternate embodiment includes hook 40, shown in FIG. 5.

Figure 6:
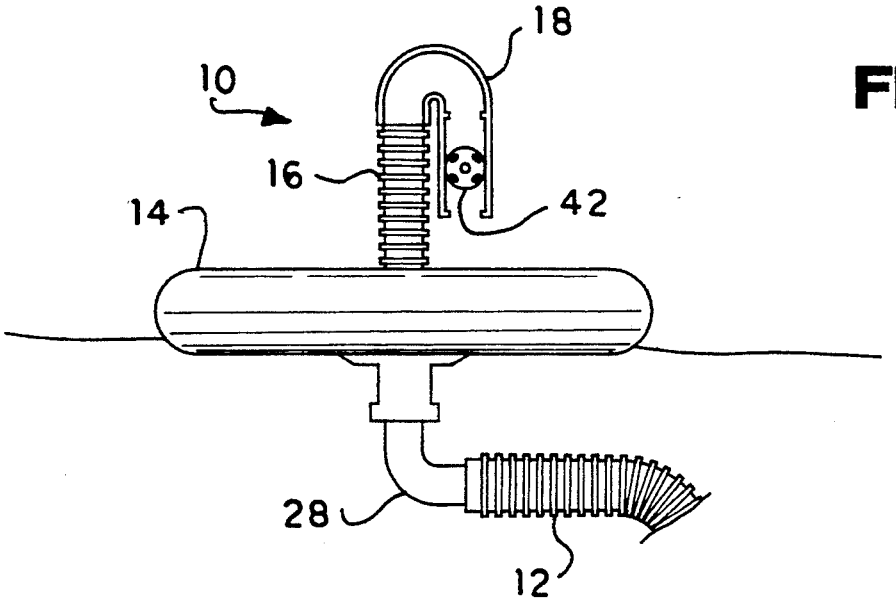
FIG. 6 is a side elevational view of an alternative embodiment, showing a visible breathing indicator.

An indicator incorporated into weather hood 18 enables an observer to ascertain that a novice user is breathing properly. A first embodiment providing this benefit, seen in FIG. 6, comprises a perforated ball 42 captively retained in weather hood 18. In this embodiment, weather hood 18 is translucent or transparent, and ball 42 is visible from above the water as it bobs in response to air flow in weather hood 18 and air intake tube 16.

Figure 7:
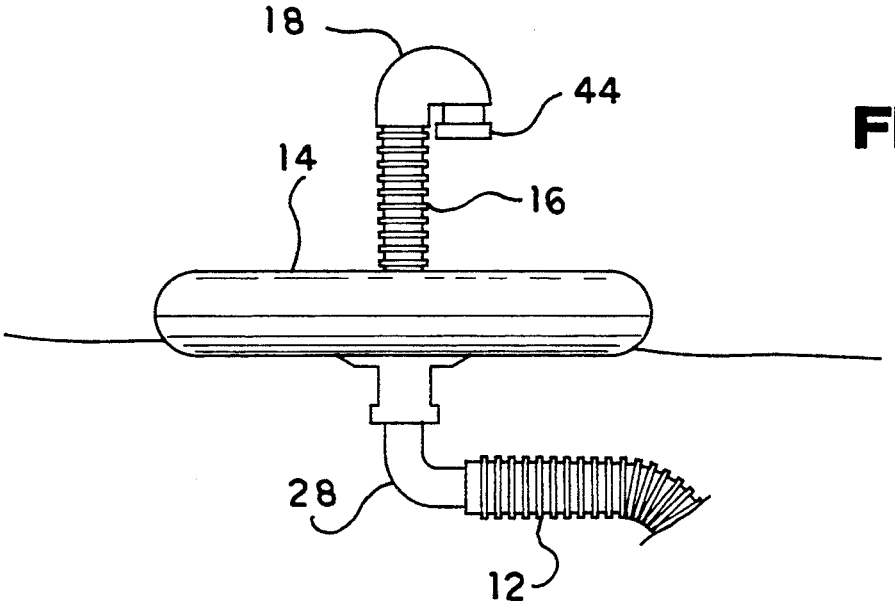
FIG. 7 is a side elevational view of an alternative embodiment, showing an audible breathing indicator.

A further alternate embodiment includes an audible activity indicator, shown in FIG. 7. The indicator comprises a whistle 44 arranged to emit sound during inhaling. Of course, both indicators could be included.

It is to be understood that the present invention is not limited to the embodiments described above, but encompasses any and all embodiments within the scope of the following claims.

I claim:

1. An underwater breathing apparatus comprising:

a mouthpiece consisting of a housing defining a chamber having a minimal volume and containing an inlet check valve and an outlet check valve sealing said chamber, air being constrained to flow only into said chamber through said inlet check valve and only out of said chamber through said outlet check valve, a conduit communicating between said chamber and a user's mouth, wherein breathing air is drawn from and spent air is expelled to said chamber;

a flexible breathing tube supplying air to said mouthpiece, said breathing tube having a proximal end and a distal end, said breathing tube's distal end connecting to said mouthpiece through said inlet check valve;

a floating air pickup member attached to said breathing tube at said proximal end, said pickup member consisting of a float, means for permitting an observer to monitor the breathing of a user of the underwater breathing apparatus, said means for permitting monitoring comprising a visible indicator consisting of a transparent air pickup tube extending upwardly from said float and terminating above water level, said air pickup tube containing a perforated ball constrained to bob in response to air flow therethrough, a right-angled conduit connecting said air pickup to said tube's proximal end, and enabling fluid communication therebetween, said right-angle conduit extending downwardly from said float and causing said breathing tube to be disposed substantially parallel to the surface of the water, whereby a user breathes through said mouthpiece while underwater, air supply to the user being constrained to flow into said air pickup tube, through said right-angled conduit and said flexible breathing tube to said mouthpiece, through said inlet check valve to said chamber, to the user's mouth and back into said chamber through said mouthpiece conduit, and is expelled by pneumatic pressure from said mouthpiece chamber into surrounding water, and wherein said right-angled conduit further includes a swivel means for enabling said right-angled conduit to rotate relative to said floating member, for avoiding entanglement of said breathing tube with said floating member, and for promoting stability of said floating member to prevent intake of water into said air pickup tube when a user exerts a lateral pull rather than a downward pull on said float.

2. The underwater breathing apparatus according to claim 1, wherein said right-angled conduit includes means connecting to and enabling air flow to more than one said breathing tube, whereby more than one user uses said underwater breathing apparatus.

3. The underwater breathing apparatus according to claim 1, wherein said floating member includes a central opening therein, and has a web which extends across and seals said central opening, thus forming a tray, to enable a user to collect and carry small items within said tray.

4. The underwater breathing apparatus according to claim 1, said floating member having a brightly colored exterior surface, whereby an observer easily identifies the location thereof.

5. The underwater breathing apparatus according to claim 1, wherein said air pickup tube has a weather hood, thereby minimizing influx of water and foreign objects into said air pickup tube.

6. The underwater breathing apparatus according to claim 1, wherein said right-angled conduit includes attachment means for fastening an object thereto.

7. The underwater breathing apparatus according to claim 6, wherein said attachment means comprise a hook.

8. The underwater breathing apparatus according to claim 6, wherein said attachment means comprise an eyelet.

9. The underwater breathing apparatus according to claim 1, wherein said breathing tube is of bellows construction.

* * * * *